United States Patent [19]

Albinger, Jr.

[11] Patent Number: 4,523,079

[45] Date of Patent: Jun. 11, 1985

[54] ELECTRIC IRON HAVING ELECTRONIC CONTROL CIRCUIT WITH A POWER RESISTOR MOUNTED ON THE SOLEPLATE

[75] Inventor: Harry Albinger, Jr., Monroe, Conn.

[73] Assignee: Black & Decker Inc., Newark, Del.

[21] Appl. No.: 533,933

[22] Filed: Sep. 20, 1983

[51] Int. Cl.[3] ..... H05B 1/02; D06F 75/18; D06F 75/26

[52] U.S. Cl. ..... 219/251; 38/77.83; 38/82; 219/209; 219/254; 219/501; 338/51

[58] Field of Search ..... 219/245, 251, 252, 253, 219/254, 255, 501, 209; 38/77.83, 82; 338/51

[56] References Cited

U.S. PATENT DOCUMENTS

| | | | |
|---|---|---|---|
| 2,541,118 | 2/1951 | Sparklin et al. | 219/254 |
| 3,541,489 | 11/1970 | Person | 338/51 |
| 3,703,777 | 11/1972 | Knapp | 38/77.83 |
| 3,732,394 | 5/1973 | Cusworth | 219/251 |
| 3,747,241 | 7/1973 | Davidson | 38/77.83 |
| 4,045,894 | 9/1977 | Toft et al. | 38/77.83 |
| 4,091,265 | 5/1978 | Richards | 219/501 |
| 4,091,551 | 5/1978 | Schaeffer | 38/77.83 |
| 4,130,954 | 12/1978 | Walker | 38/77.83 |
| 4,322,900 | 4/1982 | Hacker et al. | 219/252 X |
| 4,347,428 | 8/1982 | Conrad et al. | 219/251 |
| 4,365,138 | 12/1982 | Hess | 219/200 |

FOREIGN PATENT DOCUMENTS

| | | | |
|---|---|---|---|
| 2944242 | 5/1981 | Fed. Rep. of Germany | 219/251 |
| 1068419 | 5/1967 | United Kingdom | 219/251 |
| 2042856 | 9/1980 | United Kingdom | 219/209 |

*Primary Examiner*—A. Bartis

*Attorney, Agent, or Firm*—Paul J. Lerner

[57] ABSTRACT

An electric steam iron includes a plastic housing shell forming a hollow handle structure and a soleplate with steam generating means and ports for distribution of steam. A pump actuated by a handle button delivers water from a tank within the housing shell to the steam generating means. The iron is controlled by a low DC voltage electronic control including a printed circuit board disposed in the housing shell away from the soleplate and having means including a power resistor for reducing high AC line voltage to low DC supply to the circuit. The shell and hollow handle structure are open to the soleplate and the printed circuit board is directly exposed to heat from the power resistor. The power resistor is mounted directly on the soleplate between a pair of upstanding ribs on the soleplate and is cemented in thermally close coupling thereto by a heat transfer compound so that substantially all of the heat from the power resistor is conducted directly into the soleplate during use of the iron, thus preventing excessive heating of the printed circuit board and allowing the printed circuit board to be located within the housing shell.

7 Claims, 3 Drawing Figures

ELECTRIC IRON HAVING ELECTRONIC CONTROL CIRCUIT WITH A POWER RESISTOR MOUNTED ON THE SOLEPLATE

BACKGROUND OF THE INVENTION

1. Field of the Invention

The invention herein pertains to an electric steam iron having low DC voltage electronic circuit control means including a printed circuit board mounted high in the iron handle away from the heat of the soleplate. A power resistor is used to reduce 120 volt AC line supply to a low voltage DC supply to operate the electronic circuit. The resistor is mounted directly on the hot soleplate to dissipate its heat to the soleplate so the hot soleplate acts as a heat sink for the heat loss of the resistor.

2. Description of the Prior Art

In steam irons with electronic circuit control features such as a ready light and automatic shut-off, as well as thermosatic control and numerous other convenience features, it is necessary to reduce normal AC line voltage to a low voltage DC supply to operate the electronic circuit. It is customary to provide means such as a transformer or the like for voltage reduction and then rectify it for low voltage DC to operate the electronic control means. Also, it is standard practice now to use plastic housings for aesthetic and lightweight purposes in modern day irons. The plastics used are generally not resistant to high heat as the old metal irons were and it is necessary to protect the electronic circuitry by mounting it well removed from the hot soleplate and provide a separate and protective environment. Typical of such iron is that shown in U.S. Pat. No. 4,347,428 where the heat susceptible components are well removed from the soleplate. Thus, the main object of the invention is to provide an electric iron using a low DC voltage electronic circuit control with a printed circuit board well protected from the heat of the soleplate. This is accomplished in the present invention by actually using the hot soleplate as a heat sink for dissipating unwanted heat.

DESCRIPTION OF THE PREFERRED EMBODIMENT

It is to be understood that the embodiment described is intended merely to show the location and concept of the present invention and the invention is applicable to any electronically controlled iron using PC boards that must be heat protected. This is especially true in plastic irons and such concept disclosed herein is especially applicable to irons of the general arrangement as shown in U.S. Pat. Nos. 3,747,241 and 4,130,954 of common assignment which are typical of the overall arrangement to which the present invention may be applied as well as to dry ironing whether including steam or not.

Figure 1:
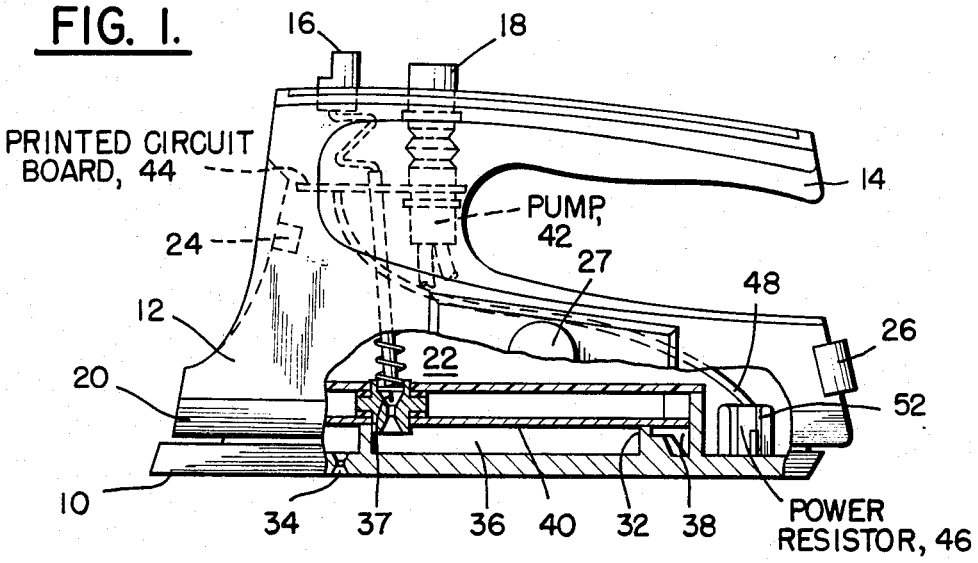
FIG. 1 is an elevation view, partly broken away, illustrating a typical iron with location of parts of the invention.

Referring to FIG. 1, and for purposes of easy description, there is shown a small lightweight plastic iron of the general type shown in U.S. Pat. No. 4,091,551 of common assignment for steam and extra surge capacity and having a soleplate 10 with any number of conventional steam ports therein, a preferably one-piece molded plastic contoured housing shell 12 formed with a handle 14 and having a conventional steam button 16 and extra surge button 18. A separate plastic skirt 20 isolates housing shell 12 from hot soleplate 10 and an internal enclosed water tank 22 may be part of the plastic housing and is filled through the front of the iron at fill opening 24. A stabilizing bar 26 steadies the iron in a heel rest position and may be used to wind the electrical cord not shown.

Because of the arrangement of this particular iron described, the conventional forward handle-mounted thermostat of the type in U.S. Pat. No. 3,747,241 or a saddle plate control under handle 14 in some irons as in U.S. Pat. No. 3,703,777 becomes difficult because of the complex linkage required and the presence of water tank 22 respectively. To overcome these difficulties a side thermostat button 27 is provided to set the temperature in this compact iron arrangement. The detailed side thermostat control is the subject of U.S. Pat. No. 4,045,894 of common assignment.

Referring to U.S. Pat. No. 4,091,551 and to FIG. 2 herein, an aluminum soleplate assembly 10 is shown with a heating means 28 that may form part of the soleplate casting and comprising a continuous rod containing magnesium oxide that loops around the iron generally coming to a point at the nose and having terminal means 30 at the rear for connection to an electric AC source as is well-known. Also, as part of the soleplate casting is a series of ribs 32 suitably formed for distributing steam in a known manner out through soleplate ports 34.

To provide normal steam from the iron, a forward generator 36 receives water drops at its front through valve assembly 37 when button 16 is in the up position all as shown and as well-known. The water dropping into the hot steam generator 36 flashes into steam and the resulting steam is distributed by ribs 32 through exit ports 34. For an extra surge of steam in the iron described, there is provided a rear surge generator 38 which is supplied with an extra quantity of water directly as shown to generate steam on demand, the steam following through the distribution passages formed by ribs 32 in a slightly different manner from the forward steam generator. Cooperating with ribs 32 and soleplate 10 there is provided a coverplate 40 to define the steam distributing means from both generators 36 and 38. For delivering water to the soleplate for steam generation, a suitable internal pump 42 and water valve structure 37, both individually known in the art, are connected respectively to buttons 18 and 16 and to the tank for manually and selectively delivering water to the steam soleplate generators 36 and 38. This is the general operation described in said U.S. Pat. No. 4,091,551 patent supra.

With improved irons using electronic controls to sense and activate different functions, and using modern day technology, it is possible to provide a complete low voltage DC electronic circuit control means all on a single printed circuit (PC) board to control many iron functions such as a ready light, automatic shut-off, temperature control, or various other desired features. However, heat is generally an enemy of such control circuitry and, of course, an iron is designed as a large heat generator. Thus, it becomes necessary to isolate the electronic circuit control means and its printed circuit board and this is usually done by locating the circuitry or control apparatus as far away from the soleplate as possible. Typical of this structure is shown in U.S. Pat. No. 4,347,428 directed to heat protection of the controlling circuit board. Also, the use of plastic housings or shells additionally requires the control circuitry to be well removed from the massive soleplate heat generator for isolating it from the heat due to the poor conductivity of the plastic which cannot conduct heat away from the circuitry. Since irons operate from AC house voltage, and the electronic circuitry from a low voltage DC supply, it is necessary to reduce and rectify the voltage if the iron is to be controlled by the low DC voltage electronic control means. The ideal voltage reducer is a transformer which both isolates and reduces the voltage but this is a rather bulky extra piece of equipment and in a normal steam iron there is little or no room for such a transformer. Further, the high ambient temperature within the iron would increase the cost of the transformer to further discourage its use.

In accordance with the invention, a power resistor can be used to reduce the voltage to a level where it can be rectified and filtered to energize the electronic circuit but such a resistor dissipates sufficient power or has high enough $I^2R$ loss to raise the temperature of the surrounding air enough that the plastic enclosure would be heated beyond its temperature rating.

However, the invention discloses a means to mount the power resistor on the hot aluminum soleplate so that the plastic enclosure housing shell temperature is not adversely affected. In other words, the invention proposes the use of a power resistor which requires a lot of heat dissipation, and mounts it on the hot soleplate so that the hot soleplate itself becomes a heat sink to absorb the $I^2R$ loss of the power resistor. This is applicable whether the iron is used dry or as a steam iron.

This is the concept of the present invention and, in order to carry it out, a printed circuit board 44 is disposed in the housing shell 12 well away from the soleplate such as high in the handle in the forward portion as diagrammatically shown in FIG. 1. This control board may perform many suitable functions as in said U.S. Pat. No. 4,347,428 patent and the details are not part of the invention. Suffice to say, the AC line voltage must be reduced to supply the printed circuit board for the electronic control and this is achieved by a power resistor 46 of suitable size and design which power resistor is disposed directly on a soleplate 10 mounting so that it is in a thermally close coupling to the soleplate. The power resistor 46 is suitably connected to the circuit board, as diagrammatically shown at 48, since it is used to reduce the AC voltage to DC voltage—losing much heat in the process. The reduced voltage can be rectified and used by the remote printed circuit board 44 to control some iron functions e.g. temperature, ready lights, audio signals, and iron motion detector.

Figure 2:
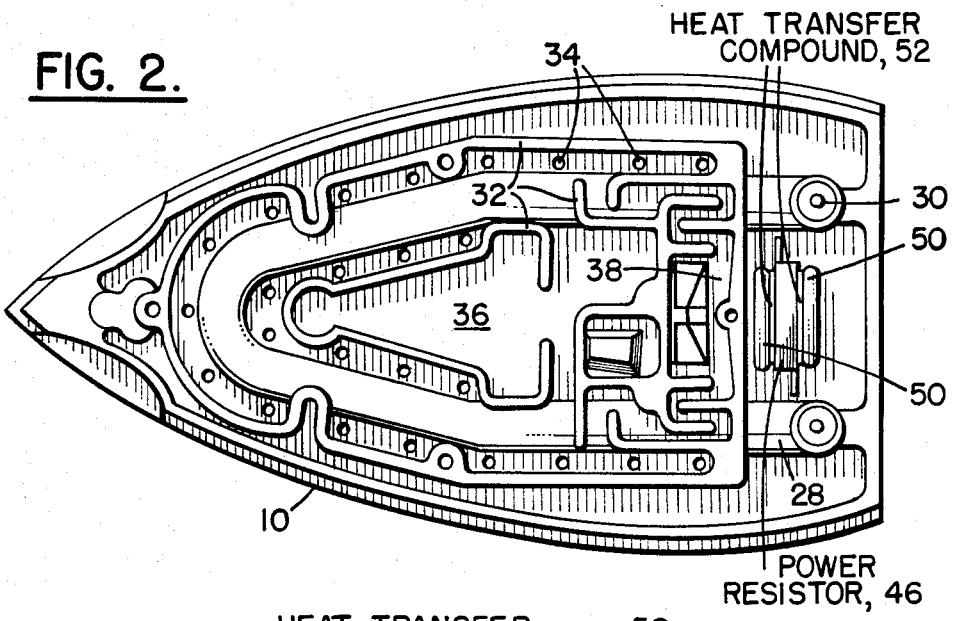
FIG. 2 is a plan view of a typical soleplate of such iron showing the location of the invention, and, FIG. 3 is a partial perspective view showing the soleplate mounting arrangement.
Figure 3:
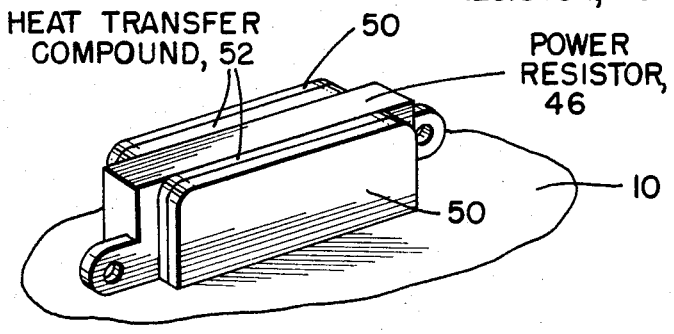

Structurally, soleplate 10 may have molded directly thereto suitable spaced ribs 50 such as the pair shown. Ribs 50 form an integral part of the soleplate being molded on the inside surface thereof as shown in FIGS. 1 and 2 forming a mounting location in the form of a box enclosure for the power resistor directly on the soleplate. In order to secure the desired close heat or thermal coupling, it is preferable that the spacing between the ribs be larger than the power resistor so the resistor can be disposed therein directly and preferably with one of its sides in contact with the soleplate as shown in FIG. 3 and the enclosing space may be filled with a heat transfer compound 52. The compound locks the resistor in place by cementing the resistor against the soleplate whereby substantially all the resistor heat is conducted directly into the hot soleplate. Thus, by thermally close coupling the resistor to the soleplate by placing an excellent heat transferring or cementing compound between the resistor and the aluminum soleplate and ribs, it is possible to dissipate, for example, 12 watts of power in a 600 ohm, 7 watt resistor which is designed for maximum surface temperature of 500° F. This dissipation of 12 watts was actually done while keeping the surface of the resistor within a 500° F. limit when the soleplate was at 400° F. Since substantially only the top of the resistor is exposed, in the structure described, very little area is available to radiate higher temperature heat to the plastic housing and substantially all of the heat is conducted directly into the hot soleplate which thereby acts as a heat sink.

Thus, the present invention enables the use of an inexpensive power resistor to isolate and reduce the voltage from normal AC to low voltage DC for controlling the electronic circuitry. This is possible by the invention recognizing and disclosing the use of the normally hot soleplate—the one area that circuitry would not normally be desired, as a heat sink and directing the $I^2R$ loss of the power resistor directly into the hot soleplate while maintaining the electronic control circuit board well removed from heat high in the forward portion of the handle.

While I have hereinabove shown a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. An electric iron comprising a housing shell forming a hollow handle structure and a heat generating soleplate, said shell, including said hollow handle structure being open to said soleplate, low DC voltage electronic circuit control means including a printed circuit board disposed in the housing shell away from the soleplate, and means to reduce high AC line voltage to low DC supply to said circuit, said means including a connected power resistor, said printed circuit board being directly exposed to heat from said power resistor, means mounting said resistor on said soleplate, in a thermally close coupling thereto, whereby the hot soleplate forms a heat sink to dissipate resistor heat preventing excessive heating of the printed circuit board.

2. An electric steam iron comprising an enclosed tank in a housing shell, said housing shell forming a hollow handle structure, a soleplate with steam generating means and ports for distribution of steam, a pump connected to the tank with a handle button for manual actuation to deliver water to the soleplate generating means, low DC voltage electronics circuit control means including a printed circuit board disposed in the housing shell away from the soleplate, means to reduce high AC line voltage to low DC supply to said circuit, said means including a connected power resistor, said shell including said hollow handle structure being open to said sole plate and said printed circuit board being directly exposed to heat from said power resistor, and means mounting said resistor on said soleplate, in thermally close coupling thereto.

whereby the hot soleplate forms a heat sink to dissipate resistor heat, preventing excessive heating of the printed circuit board.

3. An electric steam iron as described in claim 2 wherein the housing shell is plastic.

4. An electric steam iron as described in claim 3 wherein said circuit board is disposed high in the handle.

5. An electric steam iron as described in claim 3 wherein the soleplate has molded space ribs on the inside surface thereof, said ribs forming a mounting location for said resistor.

6. An electric steam iron as described in claim 5 wherein the spacing between said ribs is larger than the power resistor to contain said resistor therein and, a heat transfer compound cementing said resistor in place.

7. An electric steam iron as described in claim 6 wherein said ribs form a sided box enclosure, said resistor disposed therein with one side in contact with the soleplate, and said compound locks the resistor against the soleplate to dissipate substantially all the resistor heat into the hot soleplate heat sink.

* * * * *